US009127670B2

(12) United States Patent
Montipo'

(10) Patent No.: US 9,127,670 B2
(45) Date of Patent: Sep. 8, 2015

(54) GEARED HYDRAULIC MACHINE

(75) Inventor: Fulvio Montipo', Reggio Emilia (IT)

(73) Assignee: INTERPUMP ENGINEERING S.R.L., Reggio Emilia (IT)

( * ) Notice: Subject to any disclaimer, the term of this patent is extended or adjusted under 35 U.S.C. 154(b) by 117 days.

(21) Appl. No.: 13/515,202

(22) PCT Filed: Dec. 6, 2010

(86) PCT No.: PCT/IB2010/003139

§ 371 (c)(1),
(2), (4) Date: Jun. 11, 2012

(87) PCT Pub. No.: WO2011/077209

PCT Pub. Date: Jun. 30, 2011

(65) Prior Publication Data

US 2013/0004356 A1 Jan. 3, 2013

(30) Foreign Application Priority Data

Dec. 23, 2009 (IT) ..... RE2009A0122

(51) Int. Cl.

| | |
|---|---|
| ***F01C 19/10*** | (2006.01) |
| ***F01C 1/18*** | (2006.01) |
| ***F04C 2/00*** | (2006.01) |
| ***F04C 15/00*** | (2006.01) |
| ***F01C 1/24*** | (2006.01) |
| ***F04C 2/08*** | (2006.01) |
| ***F04C 2/18*** | (2006.01) |

(52) U.S. Cl.

CPC . *F04C 2/086* (2013.01); *F04C 2/18* (2013.01); *F04C 2240/70* (2013.01); *F04C 2250/00* (2013.01)

(58) Field of Classification Search

CPC ..... F04C 2/14
USPC ..... 418/205, 133, 104, 189, 131, 132, 418/206.1, 171, 201.1, 206.7
See application file for complete search history.

(56) References Cited

U.S. PATENT DOCUMENTS

| | | | | | |
|---|---|---|---|---|---|
| 2,865,302 | A | * | 12/1958 | Murray | 418/78 |
| 3,474,736 | A | * | 10/1969 | Lauck | 418/74 |
| 4,245,969 | A | * | 1/1981 | Caslow et al. | 418/132 |
| 4,253,808 | A | * | 3/1981 | White | 418/126 |
| 5,273,411 | A | * | 12/1993 | Lipscombe | 418/132 |
| 2004/0241031 | A1 | | 12/2004 | Komatsu et al. | |

FOREIGN PATENT DOCUMENTS

| | | | |
|---|---|---|---|
| GB | 2118259 | A | 10/1983 |
| WO | 2004053333 | A1 | 6/2004 |
| WO | 2007031092 | A1 | 3/2007 |

* cited by examiner

*Primary Examiner* — Kenneth Bomberg
*Assistant Examiner* — Deming Wan
(74) *Attorney, Agent, or Firm* — Volpe and Koenig, P.C.

(57) ABSTRACT

A geared hydraulic machine destined to function as a pump or a motor, comprising at least a module (1) comprising a body (10) in which two chambers are afforded, which two chambers intersect, and each of which contains a gear (12, 13) which enmeshes with a gear (12, 13) contained in the other chamber, the body (10) having at least an open end that is closed by a cover (20) comprising at least a seating (21, 22) for a support bearing (210, 220) of at least a gear (12, 13) of the gears; the coupling between the body (10) and the cover (20) comprises at least two abutments (23, 24) which are fashioned in one of the body (10) and the cover (20), each of which abutments (23, 24) is housed in a respective sunken seating (16, 17) which is afforded in the other of the body (10) and the cover (20).

11 Claims, 5 Drawing Sheets

10
11
12
13
14
15
16
17
18
19
100
110
111
112
113
120
121
130
131
140
150
160
161
170
171
A
B
C
D
II
III

GEARED HYDRAULIC MACHINE

TECHNICAL FIELD

The invention relates to a geared hydraulic machine of a type designed to function as a pump or as a motor.

BACKGROUND ART

As is known, a geared hydraulic machine, whether of the type designed to work as a pump or as a motor, generally comprises a body in which a chamber is afforded having a transversal section conformed as a figure of 8 and consisting of two cylindrical chambers which reciprocally intersect, each of which snugly contains a gear that enmeshes with a gear contained in the other chamber.

The body can be cup-shaped, and thus can comprise a single open end, which is closed by a cover comprising the seatings for the support bearings of the gear shafts; the other support bearing of the shafts of the gears being housed in opposite seatings afforded on the bottom of the cup-shaped body. Alternatively, the body can be substantially tubular with two open opposite ends which are closed by a respective cover, each of which comprises the seatings for the bearings of the gear shafts.

In both cases, each cover is generally fixed to the body by means of a plurality of screws or bolts which insert in respective opposite holes afforded in the cover and the body.

The gears sub-divide the internal volume of the hydraulic machine into two operating environments, of which a first environment communicates with an inlet hole of a hydraulic fluid and a second environment communicates with an outlet hole of the hydraulic fluid.

When the hydraulic machine is used as a pump, the fluid is aspirated at low pressure through the inlet hole, is compressed by the rotation of the gears and thus is sent at high pressure through the outlet hole.

When the hydraulic machine is used as a motor, the fluid is supplied at high pressure through the inlet hole, is used to rotate the gears, and is then discharged at low pressure through the outlet hole.

It follows that between the first operating environment of the hydraulic machine, communicating with the inlet hole, and the second operating environment, communication with the outlet hole, a certain pressure difference is always generated which in certain circumstances can reach very high levels.

This pressure difference can cause the deformation of the body of the hydraulic machine and/or the flexion of the gear shafts, from which an increase obtains in the radial distance between the gears, which causes a reduction of the positive displacement efficiency of the hydraulic machine.

The deformation of the body can further cause a displacement of the support bearings in the respective seatings, as well as a reciprocal dealignment of the bearings, especially if the body is cup-shaped, as in this case the deformation of the body is more accentuated at the open end, where the cover is located.

The dealignment is a negative phenomenon inasmuch as it reduces the efficiency of the hydraulic machine and damages the bearings, reducing the working life thereof.

To encounter these drawbacks, a solution has been proposed in which the coupling between each open end of the body and the relative cover is obtained by a non-circular edge, afforded at the open end of the body, which is housed jointedly internally of a corresponding non-circular recess afforded in a continuous flange which projects from the peripheral region of the cover. In this way, the continuous flange of the cover surrounds the edge of the body, opposing the deformation, from the inside towards the outside, to which the open end of the body is subjected due to the internal pressure.

In a further known solution the coupling between each open end of the body and the relative cover is obtained by blocking pins, each of which is housed in respective opposite elongate seatings afforded on the body and the cover. In this way, the blocking pins guarantee reciprocal positioning between the body and the cover, and oppose deformation.

Both these solutions are however rather complicated and expensive. In particular, the mechanical operations required to realise the edge and the corresponding non-circular seating of the first solution are rather complex, and thus require adequate machines and a careful programming thereof.

The mounting of the cover on the body of the second solution, which comprises inserting the blocking pins in the respective seatings, is rather slow and laborious.

DISCLOSURE OF INVENTION

An aim of the present invention is to provide a hydraulic machine in which the deformation of the body, due to the difference of internal pressure, and the displacements of the bearing in the relative seatings, are diminished.

A further aim of the present invention is to resolve, or at least reduce, the above-cited drawbacks in the prior art.

A further aim of the present invention is to attain the above-mentioned objectives in the ambit of a simple, rational and relatively inexpensive solution.

These and other aims are attained by the characteristics of the invention reported in independent claim 1. The dependent claims delineate preferred and/or particularly advantageous aspects of the invention.

The invention makes available a geared hydraulic machine destined to function as a pump or a motor, which comprises at least a module of the type delineated in the preamble hereto.

The at least a module in practice comprises a body in which two chambers are afforded, which have a preferably cylindrical shape and which intersect. Each of the chambers contains, preferably snugly, a gear which enmeshes with the gear contained in the other chamber. The body has at least an open end, which is closed by a cover comprising at least a seating for a support bearing of at least a gear.

In the invention, the coupling between the body and the cover of the module comprises at least two abutments which are fashioned in one of the body and the cover, each of which abutments is the housed in a respective sunken seating afforded in the other of the body and the cover.

The abutments and the relative sunken seatings enable the cover and the body of the hydraulic machine to be stably coupled.

The abutments and the relative sunken seatings are fashioned in a single piece with the body and the lid, such that the mounting of the hydraulic machine is overall simple and rapid.

The insertion of the abutments in the relative sunken seatings contributes to stiffening both the body and the cover, reducing the deformations and limiting the displacements of the bearings due to the internal pressure.

In a preferred aspect of the hydraulic machine, the abutments are fashioned in the cover, while the respective sunken seatings are afforded in the body.

In this way, the projecting abutments of the cover laterally oppose the deformation, from inside towards outside, to which the open end of the body is subjected due to the internal pressure.

In a further preferred aspect of the hydraulic machine, each abutment is friction-coupled in the respective sunken seating.

Thanks to this solution, the coupling between the abutments and the relative seatings provides an axial constraint which tends to keep the cover and the body united.

In a further preferred aspect of the hydraulic machine, the abutments are parallel to one another.

In this way, the mechanical operations for obtaining the abutments, as well as the relative sunken seatings, are simpler, as they do not require many different positionings of the pieces on the machine tools.

The abutments are preferably parallel to the plane containing the axes of the gears.

As the plane containing the axes of the gears is the plane which ideally separates the high-pressure environment from the low-pressure environment, this arrangement enables the abutments to more easily oppose the deformations of the body due to the internal pressures.

In a preferred embodiment of the hydraulic machine the coupling between the body and the cover further comprises at least a plug, which is inserted in respective opposite holes afforded on the body and the cover.

The plug functions as a centring element during the assembly of the cover on the body.

After the assembly, the plug enables the body to be further constrained to the cover with respect to reciprocal movements thereof in a transversal direction. In a preferred aspect of this embodiment, the coupling between the body and the cover further comprises at least two plugs, each inserted in respective opposite holes afforded on the body and the cover.

In this way, the reciprocal centring and the blocking between the body and the cover is even more precise and stable.

The longitudinal axes of the holes in which the plugs are housed are preferably contained in the plane defined by the axes of the gears.

Thanks to this solution, the plugs are less subject to stress from the internal pressure and thus last longer.

Each plug is preferably forced into the respective seatings, i.e. it is friction-inserted in the seatings.

In this way, the plugs also provide an axial constraint which tends to keep the body and the cover together.

In a preferred embodiment of the hydraulic machine, the body is cup-shaped and the bottom of the cup-shaped body comprises at least a seating for a support bearing of at least a gear.

Thanks to this solution, the number of components of the hydraulic machine is reduced, and the mounting thereof is consequently simpler and more rapid. This does not however mean that the body cannot comprise two open ends, each of which is closed by a respective cover having at least a seating for a support bearing of at least a gear.

In an embodiment of the invention, the hydraulic machine comprises a plurality of modules as described above, each of which exhibits at least a gear which is mechanically connected to a gear of at least another module. Thanks to this solution, when the machine functions as a pump, all the modules can be powered by a single motor; or, when the machine functions as a motor, the torque generated by all the modules can effectively be applied to a single drive shaft.

As each module generally comprises an inlet and an outlet for the fluid, in a preferred aspect of this embodiment the outlet of at least a module is hydraulically connected to the inlet of another module.

Thanks to this solution, the modules are crossed in series by a single fluid current, which can be used to activate all the gears, in a case in which the machine is functioning as a motor, or can be subjected to several stages of compression, in a case in which the machine is functioning as a pump.

In a further preferred aspect of this embodiment, the cover of at least a module is coupled to the body of another module.

In this way, overall a machine is obtained which is compact and destined to be transported and installed in a single piece.

BRIEF DESCRIPTION OF DRAWINGS

Further characteristics and advantages of the invention will emerge from a reading of the following description, which is provided by way of non-limiting example, with the aid of the figures illustrated in the accompanying tables of drawings.

BEST MODE FOR CARRYING OUT THE INVENTION

Figure 7:
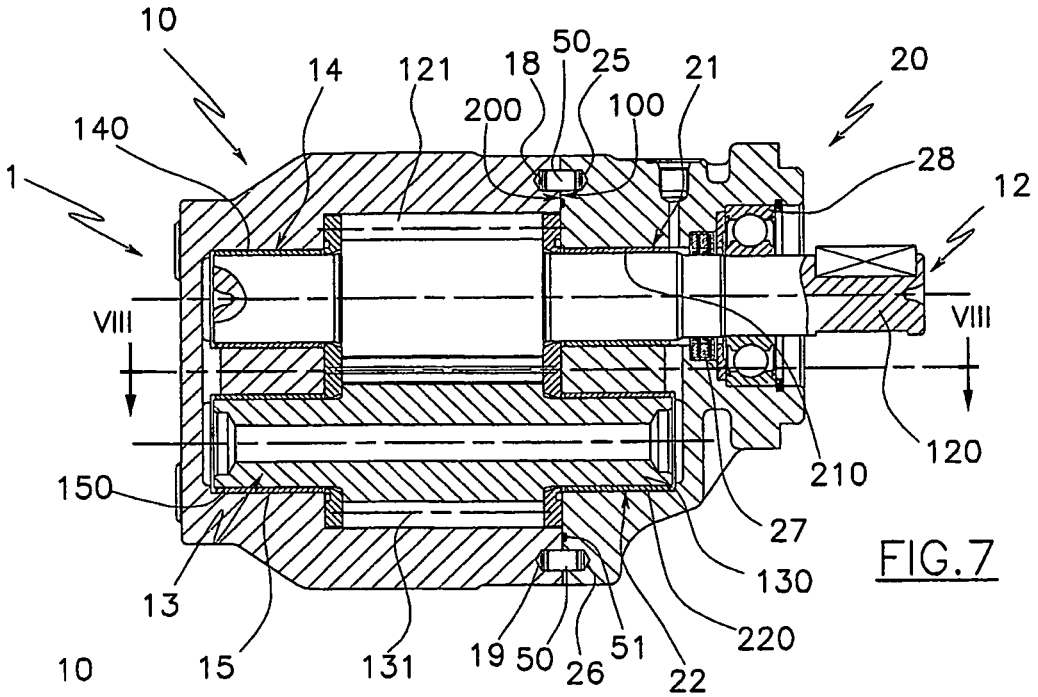
FIG. 7 is a section of the hydraulic machine obtained by assembly of the body of FIG. 1 and the cover of FIG. 4.
Figure 8:
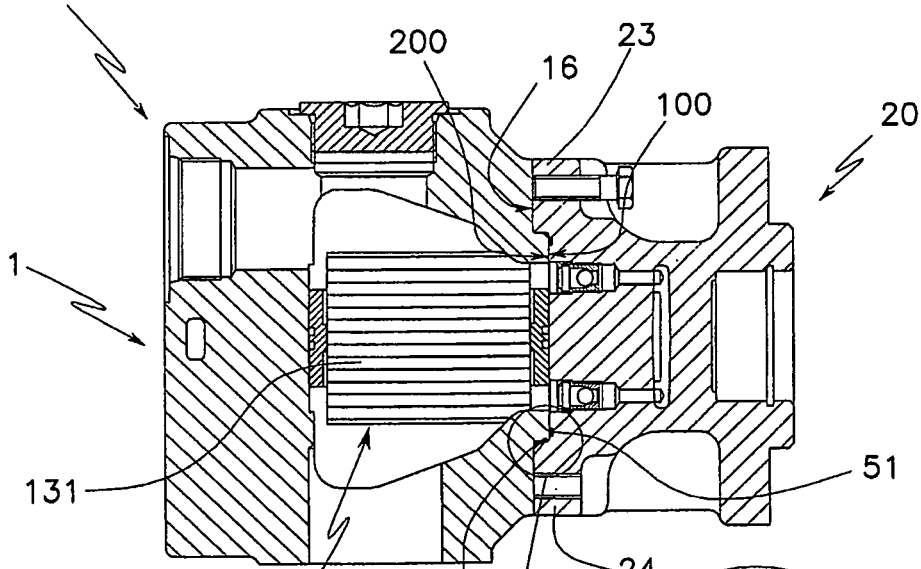
FIG. 8 is section VIII-VIII of FIG. 7.
Figure 9:
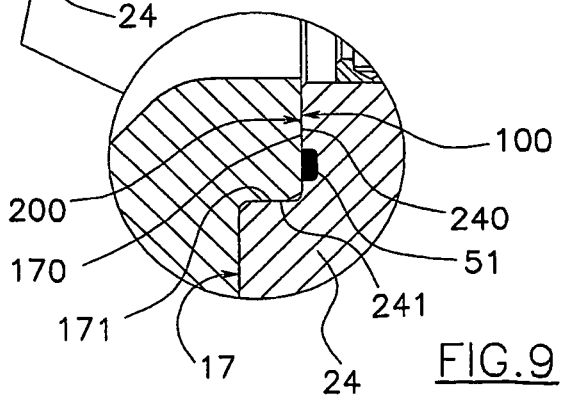
FIG. 9 is an enlarged detail of FIG. 8.

The hydraulic machine illustrated in FIGS. 7 and 8 comprises a single module 1.

The module 1 comprises a body 10 which is illustrated in figures from 1 to 3. The body 10 is cup-shaped (see FIG. 2), i.e. it comprises a perimeter wall having an open end and an opposite end which is closed, a bottom wall of which is realised in a single piece with the perimeter wall.

The body 10 delimits an internal compartment 11 having a transversal section conformed as a figure of 8 (see FIG. 1), which consists in two cylindrical chambers which intersect.

The longitudinal axes A and B of the cylindrical chambers are parallel to one another and perpendicular to the bottom wall of the body 10.

The cylindrical chambers are closed by the bottom wall of the body 10, while they are open at the opposite end, where they define the mouth of the compartment 11.

A gear 12 is snugly contained in one of the cylindrical chambers, which gear enmeshes with a second gear 13 which is snugly contained in the other cylindrical chamber.

In this way, the gears 12 and 13 subdivide the internal volume of the compartment 11 into two separate environments (see FIG. 3) of which a first environment 110 is in communication with an inlet 111 for a hydraulic fluid, and a second environment 112 is in communication with an outlet 113 for the hydraulic fluid.

In more detail, the gear 12 comprises a rotating shaft 120, and a cogged crown 121 which is associated to a central portion of the rotating shaft 120.

The gear 13 similarly comprises a rotating shaft 130, and a cogged crown 131 which is associated to a central portion of the rotating shaft 130.

Two cylindrical seatings 14 and 15 (see FIG. 2) are afforded on the bottom wall of the body 10, each of which cylindrical seatings 14 and 15 is coaxial to a respective cylindrical chamber of the compartment 11.

A support bearing, respectively 140 and 150, is coaxially inserted in each cylindrical seating 14 and 15, which support bearing 140, 150 houses an end of the rotating shaft 120, 130 of a respective gear 12 and 13.

In the illustrated embodiment, the support bearings 140 and 150 are singly constituted by a bushing made of a low-friction coefficient material, for example brass, in which the shaft of the relative gear 12 or 13 is free to rotate.

This does not however exclude the possibility that the support bearings 140 and/or 150 might be of another type, for example roller bearings.

Thanks to this coupling, the longitudinal axes of the rotating shafts 120 and 130 coincide respectively with the axes A and B of the cylindrical chambers of the compartment 11, while the relative cogged crowns 121 and 131 are enmeshed with respect to one another and are completely contained internally of the compartment 11.

The opposite end of each rotating shaft 120 and 130 projects from the mouth of the compartment 11.

The mouth is afforded at a flat surface 100 of the body 10, which is perpendicular to the axes A and B.

The flat surface 100 exhibits two lateral sunken seatings, denoted respectively by 16 and 17 (see FIG. 3), which can be realised for example by milling.

Each sunken seating 16 and 17 is defined by a lowered plane, respectively 160 and 170, parallel to the flat surface 100, and by a step, respectively 161 and 171, which separates the lowered plane from the flat surface 100.

Figures 1, 2, 3:
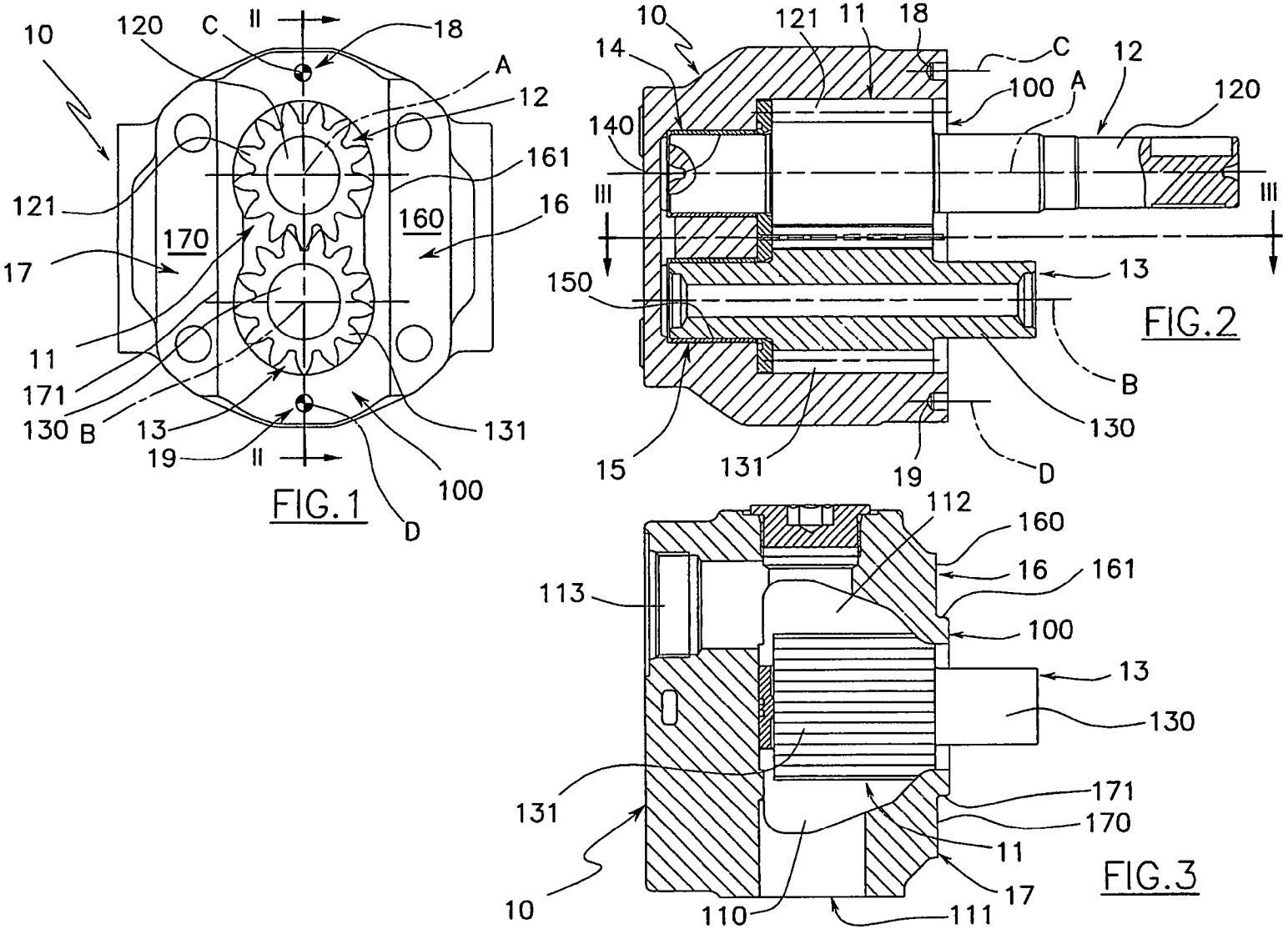
FIG. 1 is a front view of a body of a hydraulic machine of the invention.
FIG. 2 is section II-II of FIG. 1.
FIG. 3 is section III-III of FIG. 2.
Figure 5:
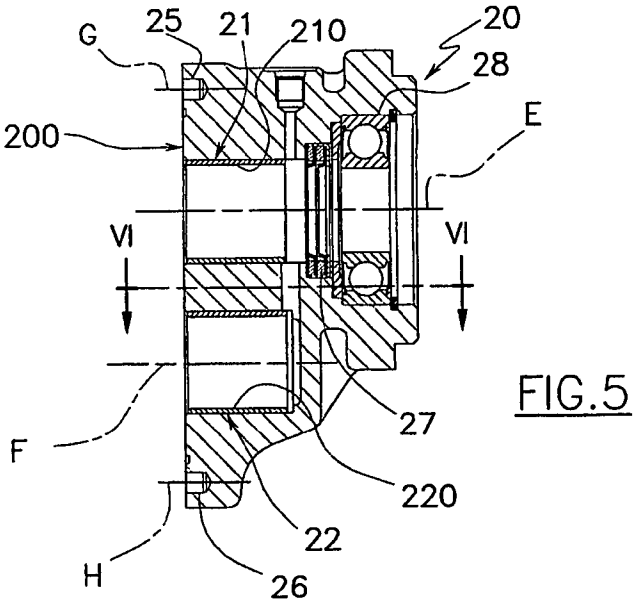
FIG. 5 is section V-V of FIG. 4.

With the exception of the side defined by the step 161, 171, the lowered plane 160 and 170 of each sunken seating 16, 17 extends in plan view up to the external edge of the body 10 (see FIG. 1).

The steps 161 and 171 are of a same height, i.e. the sunken seatings 16 and 17 have a same depth with respect to the flat surface 100.

The steps 161 and 171 are arranged on opposite sides of the plane containing the axes A and B, such as not to intersect the mouth of the compartment 11.

The plan-view profile of both steps 161 and 171 is straight and parallel to the plane containing the axes A and B.

Two blind holes 18 and 19 are further afforded on the flat surface 100.

The longitudinal axes C and D of the holes 18 and 19 are perpendicular to the flat surface 100, and are contained in the plane containing the axes A and B of the compartment 11.

The holes 18 and 19 are positioned on opposite sides with respect to the mouth of the compartment 11.

The mouth of the compartment 11 is closed by a cover 20 which is illustrated in figures from 4 to 6.

The cover 20 comprises two distinct cylindrical seatings, respectively 21 and 22.

The longitudinal axes E and F of the cylindrical seatings 21 and 22 are parallel, and separated by a distance equal to the distance separating the axes A and B of the compartment 11, i.e. which separates the longitudinal axes of the shafts of the gears 12 and 13.

Each cylindrical seating 21 and 22 coaxially houses a support bearing, respectively 210 and 220, which is destined to house the projecting end of the mouth of the compartment 11 of the rotating shaft 120 or 130 of a respective gear 12 and 13.

In the illustrated example, the support bearings 210 and 220 are singly constituted by a bushing made of a material having a low friction coefficient, for example brass, in which the shaft of the relative gear 12 or 13 is free to rotate.

This does not however exclude the possibility that the support bearings might be of another type, for example roller bearings.

Both the cylindrical seatings 21 and 22 open at a flat surface 200 of the cover 20 which develops perpendicularly with respect to the axes E and F.

Figure 6:
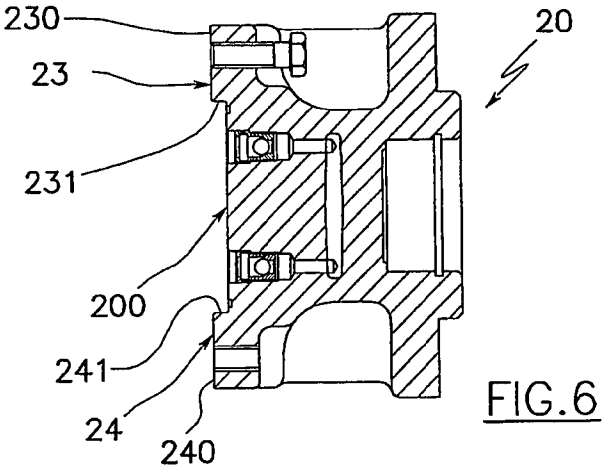
FIG. 6 is section VI-VI of FIG. 5.
Figure 4:
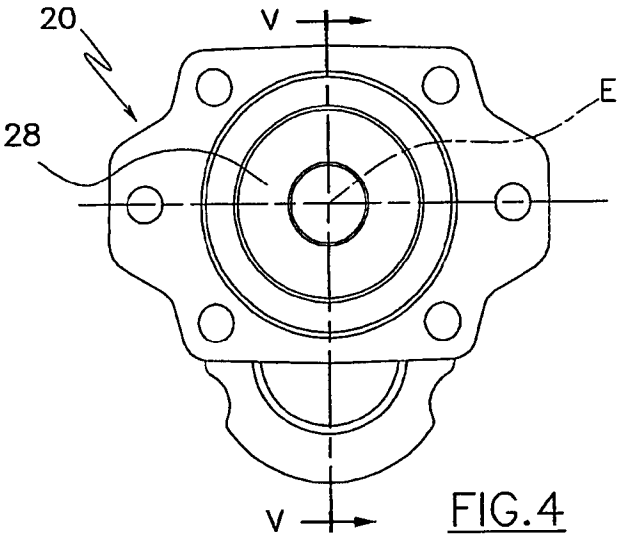
FIG. 4 is a front view of the cover destined to be coupled to the body of FIG. 1.

The flat surface 200 is provided with two lateral abutments, respectively denoted by 23 and 24 (see FIG. 6).

Each abutment 23 and 24 is defined by a raised plane, respectively 230 and 240, parallel to the flat surface 200, and by a step, respectively 231 and 241, which separates the raised plane from the flat surface 200.

With the exception of the side delimited by the step 231 and 241, the raised plane 230 and 240 of each abutment 23 and 24 extends up to the edge of the cover 20.

The steps 231 and 241 have the same height, i.e. the abutments 23 and 24 have the same height with respect to the flat surface 200.

The height is equal to the depth of the sunken seatings 16 and 17 afforded in the body 10.

The steps 231 and 241 are arranged on opposite sides with respect to the plane containing the axes E and F, such as not to intersect the mouth of the cylindrical seatings 21 and 22.

Though not visible in the figures, the plan-view profiles of both the steps 231 and 241 is straight and parallel to the plane containing the axes E and F.

The plan shape of the abutments 23 and 24 of the cover 20 coincide with the plan view shape of the sunken seatings 16 and 17 of the body and shown in FIG. 1.

Two blind holes 25 and 26 are further afforded in the flat surface 200.

The longitudinal axes G and H of the holes 25 and 26 are perpendicular to the flat surface 200, and are contained in the plane containing the axes E and F of the cylindrical seatings 21 and 22.

The hole 25 is positioned in proximity of the cylindrical seatings 21, while the hole 26 is positioned on the opposite side in proximity of the cylindrical seatings 22.

The distance between the axis G of the hole 25 and the axis E of the cylindrical seating 21 is equal to the distance between the axis C of the hole 18 and the axis A of the cylindrical seating 14 of the body 10.

Likewise, the distance between the axis H of the hole 26 and the axis F of the cylindrical seating 22 is equal to the distance between the axis D of the hole 19 and the axis B of the cylindrical seating 15 of the body 10.

The diameter of the holes 25 and 26 is equal to the diameter of the holes 18 and 19 of the body 10.

With reference to FIGS. 7 and 8, the cover 20 is coupled to the body 10 by inserting the cylindrical seatings 21 and 22 on the tracts of the shafts 120 and 130 of the gears 12 and 13 which project from the mouth of the compartment 11, obviously with an interpositioning of the support bearings 210 and 220. On this subject, note that the cylindrical seating 22 for the rotating shaft 130 is blind, while the cylindrical seating 21 passes completely through the cover 20 in order to enable the rotating shaft 120 to project externally thereof.

In this way, the rotating shaft 120 can be connected to an activating motor, in a case in which the machine is functioning as a pump, or to a transmission system, in a case in which the machine is functioning as a motor.

The cylindrical seating 22 thus also exhibits a first coaxial broadening, in which annular gaskets 27 are housed, and a second coaxial broadening, positioned externally with respect to the gaskets 27, in which a roller bearing 28 is housed, aimed at giving more fluidity and stability to the rotation of the shaft 120.

The centring of the cover 20 with respect to the body 10 is obtained by means of two cylindrical plugs 50, one of which is inserted in the hole 18 of the body 10 and in the opposite hole 25 of the cover 20, while the other is inserted in the hole 19 of the body 10 and in the opposite hole 26 of the cover 20.

The diameter of the holes 18, 19, 25 and 26 is slightly smaller than the diameter of the plugs 50, such that the plugs are forced into the respective holes, realising a friction coupling which constrains the cover 20 to the body 10 also in the axial direction.

The abutments 23 and 24 of the cover 20 are received in the sunken seatings 16 and 17 of the body 10, bringing the raised planes 230 and 240 of the abutments 23 and 24 into contact with the lowered planes 160 and 170 of the sunken seatings 16 and 17, and bringing the flat surface 200 of the cover 20 into contact with the flat surface. 100 of the body 10.

A gasket 51 is priorly interposed between the flat surface 200 of the cover 20 and the flat surface 100 of the body 10, which gasket 51 surrounds the mouth of the compartment 11.

The plan distance between the step 231 of the abutment 23 and the step 241 of the abutment 24 is slightly smaller than the plan distance between the step 161 of the sunken seating 16 and the step 171 of the sunken seating 17.

In this way, each abutment 23 and 24 couples in the respective sunken seating 16 and 17 in a friction coupling, constraining the cover 20 to the body 10 also in the axial direction.

The cover 20 can further be blocked in the axial direction by means of a plurality of screws or bolts (not illustrated) which insert in the respective opposite holes afforded in the cover 20 and the body 10.

The hydraulic machine illustrated in FIG. 10 comprises three modules 1 of the type described herein above.

In particular, each module 1 comprises a cup-shaped body 10 in which two intersection chambers are afforded, one of which contains a gear 12 which enmeshes with the gear 13 contained in the other chamber.

The body 10 of each module 1 has an open end, which is closed by a cover 20.

The coupling between the cover 20 and the body 10 is equal to the coupling described herein above:

The rotating shafts 120 and 130 of the gears 12 and 13 are singly supported by a first support bearing, respectively 140 and 150, which is coaxially inserted in a cylindrical seating, respectively 14 and 15, afforded on the bottom wall of the body 10, and by a second support beating, respectively 210 and 220, which is coaxially inserted in a cylindrical seatings, respectively 21 and 22, afforded in the cover 20.

In the following, the three modules 1 will be denoted as the first, second and third modules, on the basis of their order from left to right in reference to FIG. 10.

The three modules 1 are physically joined to one another, such as to form a single hydraulic machine destined to be transported and installed as a single piece.

In particular, the body 10 of the first module 1 and the cover 20 of the third module 1 are entirely identical to those described herein above for the first embodiment.

The covers 20 of the first and second modules 1, and the bodies 10 of the second and third modules 1, are slightly modified, in such a way that the front wall of the cover 20 of the first module 1 couples with the bottom wall of the cover of the second module 1, and in that the front wall of the second module 1 couples with the bottom wall of the body 10 of the third module 1.

Though not shown in the figures, the coupling between the covers 20 of the first and the second modules 1 with the bodies 10 respectively of the second and third modules 1, comprise the same elements described herein above for the coupling between the cover 20 and the body 10 of a single module 1.

In other words, the coupling generally comprises two abutments afforded in the bottom wall of the body 10, each of which is housed, preferably in a friction coupling, in a respective sunken seating afforded in the front wall of the cover 20, or vice versa.

Figure 10:
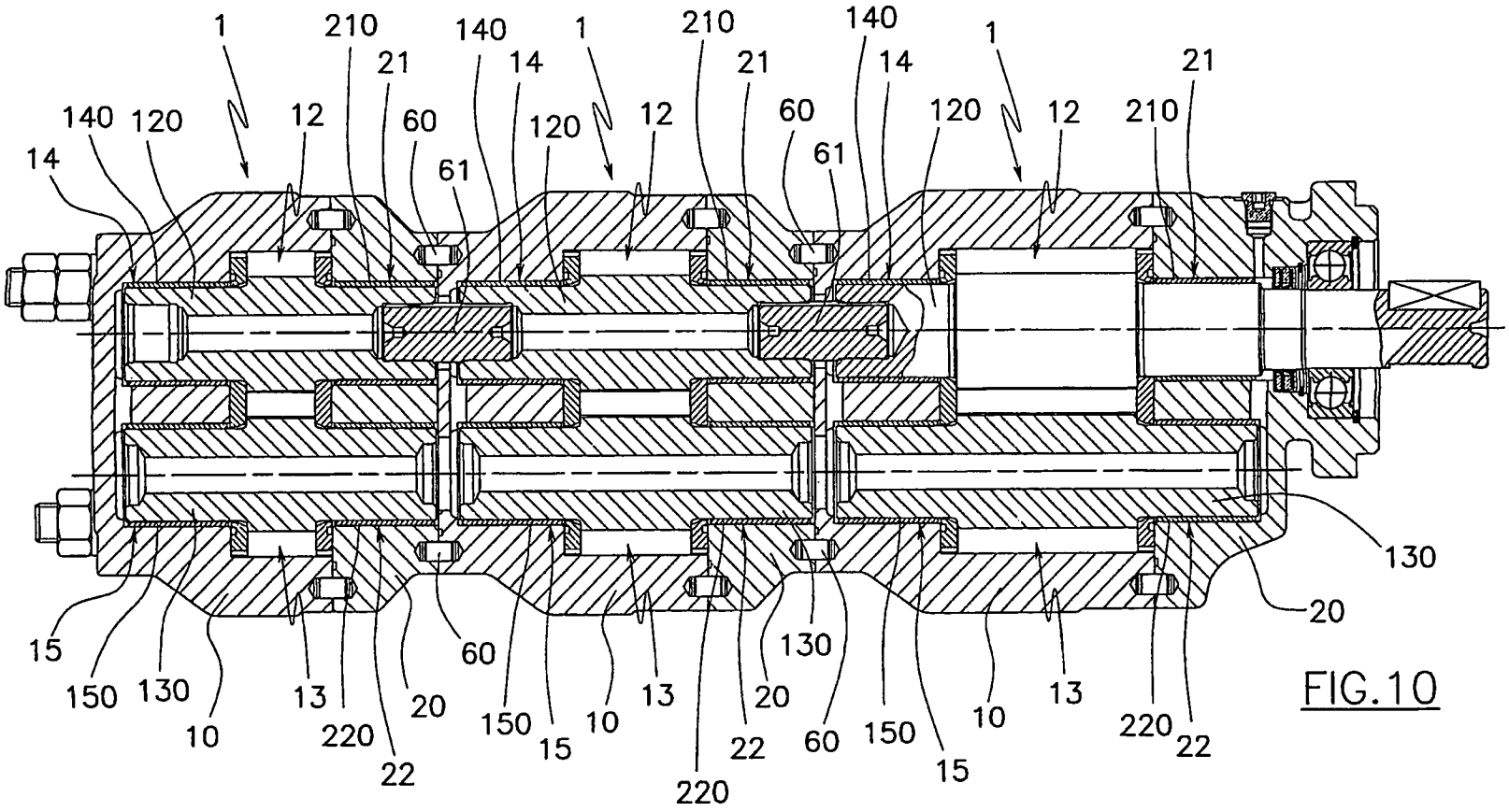
FIG. 10 is the section of FIG. 7 relating to a hydraulic machine according to an alternative embodiment.
Figure 11:
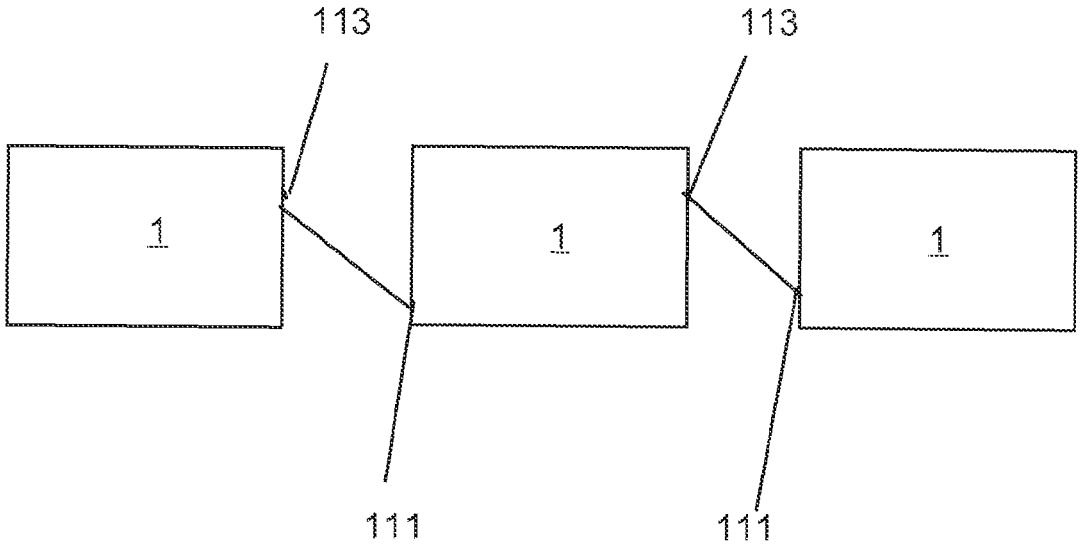
FIG. 11 is a schematic representation of the multiple module assembly shown in FIG. 10.

The abutments and seatings are parallel to the plane containing the axes of the gears 12 and 13, and thus are not visible in FIG. 10.

The coupling further comprises two plugs 60 which are inserted, preferably in a friction coupling, in respective opposite holes afforded in the front wall of the cover 20 and in the bottom wall of the body 10, and are contained in the plane defined by the axes of the gears.

In particular, the coupling is configured in such a way that the shafts 120 of the gears 12 of all the modules 1 are aligned to one another and, in the same way, that the shafts 130 of the gears 13 of all the modules 1 are aligned with one another.

As illustrated in FIG. 10, the shafts 120 of the gears 12 of all the modules 1 are mechanically connected two by two by a grooved pin 61, which engages in corresponding grooved cavities coaxially afforded at the ends of the shafts 120, passing through special openings afforded in the front wall of the cover 20 of a module 1 and in the bottom wall of the body 10 of the following module 1.

In this way, the rotation of each shaft 120 (and thus also 130) is always necessarily synchronised to the rotation of all the other shafts 120.

The rotating shaft 120 of the third and last module 1 projects externally of the relative cover 20, in order to be connected with an activating motor, in a case in which the machine functions as a pump, or with a transmission system, in a case in which the machine functions as a motor.

Although not visible in the figures, the internal volume of each module 1 is subdivided by the relative gearings 12 and 13 into two separate environments, of which a first environment which communicates with an inlet for the hydraulic fluid, and a second environment which communicates with an outlet for the hydraulic fluid.

The outlet of the first module 1 is hydraulically connected, for example by means of an external connection, to the inlet of the second module 1 and, likewise, the outlet of the second module 1 is hydraulically connected, for example by means of a further external connection, to the inlet of the third module 1.

In this way, the modules 1 are crossed in series by a single current of hydraulic fluid, which can be used to activate all the gears, in a case in which the machine functions as a motor, or can be subjected to several compression stages, in a case in which the machine functions as a pump.

Obviously a technical expert in the field might make numerous modifications of a technical-applicational nature to the above-described hydraulic machines, without its forsaking the ambit of the invention as claimed herein below.

The invention claimed is:

1. A geared hydraulic machine destined to function as a pump or a motor, the geared hydraulic machine comprising:

at least a module (1) comprising:

a body (10) having two intersecting chambers arranged therein:

two gears (12, 13) one gear (12, 13) being housed in each of the chambers and enmeshes with a gear (12, 13) contained in the other chamber, the gears (12,13) having parallel longitudinal axes (A, B); and a cover (20) that closes an open end of the body (10), the cover (20) comprising at least a seating (21, 22) for a support bearing (210, 220) of at least a gear (12, 13) of the gears, wherein a coupling between the body (10) and the cover (20) comprises at least two abutments (23, 24) projecting from a flat surface (200) of the cover (20), each of said abutments (23, 24) is housed in a respective sunken seating (16, 17) carved in a flat surface (100) of the body (10), the flat surfaces (100, 200) being perpendicular with respect to the longitudinal axes (A, B) of the gears, wherein each sunken seating (16, 17) is defined by a lowered plane (160, 170), parallel to the flat surface (100) of the body (10), and by a step (161, 171) that separates the lowered plane from the flat surface (100) of the body (10), wherein each of the abutments (23, 24) is defined by a raised plane (230, 240) parallel to the flat surface (200) of the cover (20), and by a step (231, 241) that separates the raised plane from the flat surface (200) of the cover, wherein plan-view profiles of the steps (231, 241) of said abutments (23, 24) on the flat surface (200) of the cover (20), are rectilinear for their entire length and extend up to an external perimeter of the cover (20), separated and parallel to a plane comprising both gear axes, and wherein the plan-view profiles of the steps (161, 171) of said sunken seatings (16, 17) on the flat surface (100) of the body (10) are rectilinear for their entire length and extend up to an external perimeter of the body (10), separated and parallel to a plane comprising both gear axes.

2. The hydraulic machine of claim 1, wherein each abutment (23, 24) is housed in the respective sunken seating (16, 17) with a friction coupling.

3. The hydraulic machine of claim 1, wherein the coupling between the body (10) and the cover (20) further comprises at least a plug (50) inserted in respective opposite holes (18, 25, 19, 26) arranged in the body (10) and the cover (20).

4. The hydraulic machine of claim 3, wherein the coupling between the body (10) and the cover (20) further comprises at least two plugs (50), each inserted in respective opposite holes (18, 25, 19, 26) arranged in the body (10) and the cover (20).

5. The hydraulic machine of claim 4, wherein axes (C, D, G, H) of the holes (18, 25, 9, 26) are contained in a plane defined by the axes (A, B) of the gears (12, 13).

6. The hydraulic machine of claim 3, wherein each plug (50) is inserted in the respective holes (18, 25, 19, 26) with a friction coupling.

7. The machine of claim 1, wherein the body (10) is cup-shaped, a bottom of the cup-shaped body (10) comprising at least a seating (14, 15) for a support bearing (140, 150) of at least a gear (12, 13).

8. The machine of claim 1, further comprising a plurality of the modules (1), wherein at least a gear (12) of each module (1) is mechanically connected to a gear (12) of at least a further module (1).

9. The machine of claim 8, wherein each module (1) comprises an inlet (111) and an outlet (113) for the fluid, the outlet (113) of at least a module (1) being hydraulically connected to the inlet (111) of a further module (1).

10. The machine of claim 8, wherein the cover (20) of the at least a module (1) is coupled to the body (10) of a further module (1).

11. A geared hydraulic machine destined to function as a pump or a motor, the geared hydraulic machine comprising:

at least a module (1) comprising:

a body (10) having two intersecting chambers arranged therein;

two gears (12, 13), one gear (12, 13) being housed in each chamber and enmeshes with a gear (12, 13) contained in the other chamber, the gears (12,13) having parallel longitudinal axes (A, B) and a cover (20) that closes an open end of the body (10), the cover (20) comprising at least a seating (21, 22) for a support bearing (210, 220) of at least a gear (12, 13) of the gears, wherein a coupling between the body (10) and the cover (20) comprises at least two abutments (23, 24) projecting from a flat surface (100) of the body (10), each of said abutments (23, 24) is housed in a respective sunken seating (16, 17) carved in a flat surface (200) of the cover (20), the flat surfaces (100, 200) being perpendicular with respect to the longitudinal axes (A, B) of the gears, wherein each sunken seating (16, 17) is defined by a lowered plane (160, 170), parallel to the flat surface (200) of the cover (20), and by a step (161, 171) that separates the lowered plane from the flat surface (200) of the cover (20), wherein each of the abutments (23, 24) is defined by a raised plane (230, 240) parallel to the flat surface (100) of the body (10), and by a step (231, 241) that separates the raised plane from the flat surface (100) of the body, wherein the plan-view profiles of the steps (231, 241) of said abutments (23, 24) on the flat surface (100) of the body (10) are rectilinear for their entire length and extend up to an external perimeter of the body (10), separated and parallel to a plane comprising both gear axes and wherein the plan-view profiles of the steps (161, 171) of said sunken seatings (16, 17) on the flat surface (200) of the cover (20) are rectilinear for their entire length and extend up to an external perimeter of the cover (20), separated and parallel to a plane comprising both gear axes.

* * * * *